US012564235B1

(12) United States Patent
Guidry

(10) Patent No.: US 12,564,235 B1
(45) Date of Patent: Mar. 3, 2026

(54) PROTECTIVE HEADWEAR DEVICE

(71) Applicant: Shane D. Guidry, Pierre, SD (US)

(72) Inventor: Shane D. Guidry, Pierre, SD (US)

( * ) Notice: Subject to any disclaimer, the term of this patent is extended or adjusted under 35 U.S.C. 154(b) by 0 days.

(21) Appl. No.: 18/925,280

(22) Filed: Oct. 24, 2024

Related U.S. Application Data

(60) Provisional application No. 63/545,728, filed on Oct. 25, 2023.

(51) Int. Cl.

| | |
|---|---|
| ***A42B 1/08*** | (2006.01) |
| ***A42B 1/0182*** | (2021.01) |
| ***A42B 3/12*** | (2006.01) |
| ***A42B 3/28*** | (2006.01) |

(52) U.S. Cl.
CPC ..... *A42B 1/08* (2013.01); *A42B 1/0182* (2021.01); *A42B 3/125* (2013.01); *A42B 3/283* (2013.01)

(58) Field of Classification Search
CPC ..... A42B 1/08; A42B 1/0182; A42B 3/125; A42B 3/283
See application file for complete search history.

(56) References Cited

U.S. PATENT DOCUMENTS

| | | | | |
|---|---|---|---|---|
| 3,843,970 | A * | 10/1974 | Marietta | A42B 3/127 2/415 |
| 5,365,607 | A * | 11/1994 | Benevento, Jr. | A42B 1/008 2/171.1 |
| 5,428,844 | A | 7/1995 | Dougherty | |
| 5,483,698 | A | 1/1996 | Douglas, Jr. | |
| 5,729,830 | A * | 3/1998 | Luhtala | F41H 1/00 2/200.1 |
| 7,010,814 | B2 * | 3/2006 | Benziger | A63B 23/025 2/171.2 |
| 7,404,402 | B2 | 7/2008 | Yu | |
| 8,087,101 | B2 | 1/2012 | Ferguson | |
| D811,663 | S | 2/2018 | Garland et al. | |
| 10,130,134 | B2 * | 11/2018 | Blair | A42B 3/128 |
| 2004/0107482 | A1 * | 6/2004 | Picotte | A42B 3/00 2/411 |
| 2012/0066820 | A1 * | 3/2012 | Fresco | A41D 13/0153 2/463 |

(Continued)

OTHER PUBLICATIONS

HeadSaver Head Protector. Product Listing [online]. c. 2024 by HealthSaver Australia Pty Ltd. [retrieved on May 15, 2023]. Retrieved from the Internet: <URL: https://www.healthsaver.com.au/seniors-soft-head-protector>.

(Continued)

*Primary Examiner* — Khaled Annis
(74) *Attorney, Agent, or Firm* — Cramer Patent & Design, PLLC.; Aaron R. Cramer

(57) ABSTRACT

A protective headwear device designed to absorb impact forces, comprising headwear with an interior surface, a brim, an apex, and at least one vent hole. The device includes a first impact absorbing feature positioned at the rear interior surface, a second impact absorbing feature on the lateral sides, and a third impact absorbing feature at the apex and front section. Each impact absorbing feature is removably attached to the interior surface via fastening means and is made of high-density foam for impact absorption. The features are customizable to fit a user's head and enhance protection during high-impact activities.

12 Claims, 7 Drawing Sheets

(56) References Cited

U.S. PATENT DOCUMENTS

| | | | | |
|---|---|---|---|---|
| 2013/0000017 | A1* | 1/2013 | Szalkowski | F41H 1/08 2/414 |
| 2014/0007324 | A1* | 1/2014 | Svehaug | A42B 1/08 2/412 |
| 2020/0146382 | A1* | 5/2020 | Ferguson | A42B 3/0433 |

OTHER PUBLICATIONS

Epileptic Head Gear. Blog article [online]. Medhead.blogspot.com [Posted by Matt Gillespie, published on Jan. 5, 2011; retrieved on May 15, 2023]. Retrieved from the Internet: <URL: https://medhead.blogspot.com/2011/01/epileptic-head-gear.html>.

Autism, Seizure & Epilepsy Helmets. Product Listing [online]. © 2020 Guardian Helmets [retrieved on May 15, 2023]. Retrieved from the Internet: <URL: https://guardianhelmets.com>.

* cited by examiner

PROTECTIVE HEADWEAR DEVICE

RELATED APPLICATIONS

The present device was first described in and is a continuation of U.S. Provisional Application No. 63/545,728, filed Oct. 25, 2023, the entire disclosures of which are incorporated herein by reference.

FIELD OF THE DEVICE

The present invention relates generally to headwear capable of being worn by a user that comprises impact absorbing elements concealed therein.

BACKGROUND OF THE DEVICE

Those who live with debilitating health issues that may have occurred due to injury or disease must drastically alter their lifestyle to maintain health or prevent catastrophic events. Such issues may include episodes of dizziness, fainting spells, or seizures. These episodes unfortunately may occur at any time without warning. There is a great chance of further injury during these episodes, especially to the head area, when the episodes occur when standing or in areas where a fall to the ground can occur.

Also, there are many sports that require the use of headwear in the style of a helmet such as football, baseball, bicycle riding, hockey, motor sports, and the like. All of these helmets differ in their overall appearance and function but share the common goal of protecting the user's head from impact. Different areas of coverage, padding, internal suspension, and even the materials used all share the common goal of providing impact protection. These same protective properties are also important in helmets used in medical, construction, military, and law enforcement activities as well.

A common issue many manufacturers and researchers face is developing headwear having an impact absorbing means that is more conforming to a user's head so as to substantially attenuate, or even obviate, secondary impact without adding significant costs to the production of the headwear. These types of impact absorbing means, although perhaps common in sprots or other activities where a head impact is possible or even expected, fashionable and everyday headwear often does not include these features. Accordingly, there exists a need for a means by which the protective properties of the impact absorbing means can be properly installed within headwear, and even concealed, to further their injury preventing characteristics. The development of the present invention fulfills this need.

SUMMARY OF THE DEVICE

Embodiments of the present disclosure may include a protective headwear device comprising a headwear structure having an outer surface, an interior surface, a brim, an apex, and at least one vent hole. Embodiments may also include a first impact absorbing feature disposed within a rear section of the interior surface of the headwear, the first impact absorbing feature including a first body with a generally rectangular shape and rounded corners. Embodiments may further include a first fastening means affixed to a rear surface of the first body for removably attaching the first body to the interior surface of the headwear. In some embodiments, the first body may be composed of a high-density foam material configured to absorb impact forces applied to the rear section of the headwear.

In some embodiments, the first fastening means may include a hook-and-loop fastening system, enabling removable attachment of the first body to the interior surface of the headwear. The protective headwear device may also include a second impact absorbing feature disposed on opposing lateral sides of the interior surface of the headwear, the second impact absorbing feature comprising a second body with a first side, an opposing second side, and a pair of curvilinear ends. Embodiments may further include a pair of first side pleats formed on the first side of the second body and a pair of second side pleats formed on the second side, enabling the second body to conform to the shape of the interior surface of the headwear. A second fastening means may be affixed to a rear surface of the second body for removably attaching it to the interior surface of the headwear. In some embodiments, the second body may be composed of high-density foam material configured to absorb impact forces applied to the lateral sides of the headwear.

In some embodiments, the second fastening means may include a hook-and-loop fastening system, enabling removable attachment of the second body to the interior surface of the headwear. The first side pleats and second side pleats of the second body may be offset relative to each other along a bisecting axial centerline, enhancing the conformability of the second body to the shape of the headwear.

In some embodiments, the protective headwear device may include a third impact absorbing feature disposed at the apex and extending to the front section of the interior surface of the headwear. The third impact absorbing feature may include a plurality of third bodies, each having a generally rectangular shape and interconnected along adjacent sides by a seam.

Embodiments may also include a third fastening means affixed to a rear surface of each third body for removably attaching the third bodies to the interior surface of the headwear. In some embodiments, the plurality of third bodies may be composed of high-density foam material configured to absorb impact forces applied to the apex and front section of the headwear.

In some embodiments, the seam between the plurality of third bodies may be perforated, enabling selective separation of individual third bodies to customize the coverage area. The third fastening means may include a hook-and-loop fastening system, enabling removable attachment of each third body to the interior surface of the headwear.

In some embodiments, the seam between the plurality of third bodies may function as a living hinge, providing flexibility for the third impact absorbing feature to conform to the shape of the apex and front section of the headwear. Embodiments may also include at least one of the first, second, or third impact absorbing features incorporating a moisture-wicking outer layer to enhance comfort during extended wear and reduce heat buildup.

In some embodiments, the first, second, and third impact absorbing features may each have a thickness of approximately one-half inch and a height of approximately three inches, and may be configured to be washable for ease of maintenance. The high-density foam material used in the first, second, and third impact absorbing features may provide both thermal protection and flotation capability for the headwear.

In some embodiments, the location and sizing of the first, second, and third impact absorbing features may be customizable to fit a user's head based on factors such as age, gender, hairstyle, or common injury spots. Additionally, the first, second, and third fastening means may include a waterproof adhesive for permanent attachment to the interior surface of the headwear.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 5*a* is a top view of the third impact absorbing feature 30, according to the preferred embodiment of the present invention;

DESCRIPTIVE KEY

Figure 1:
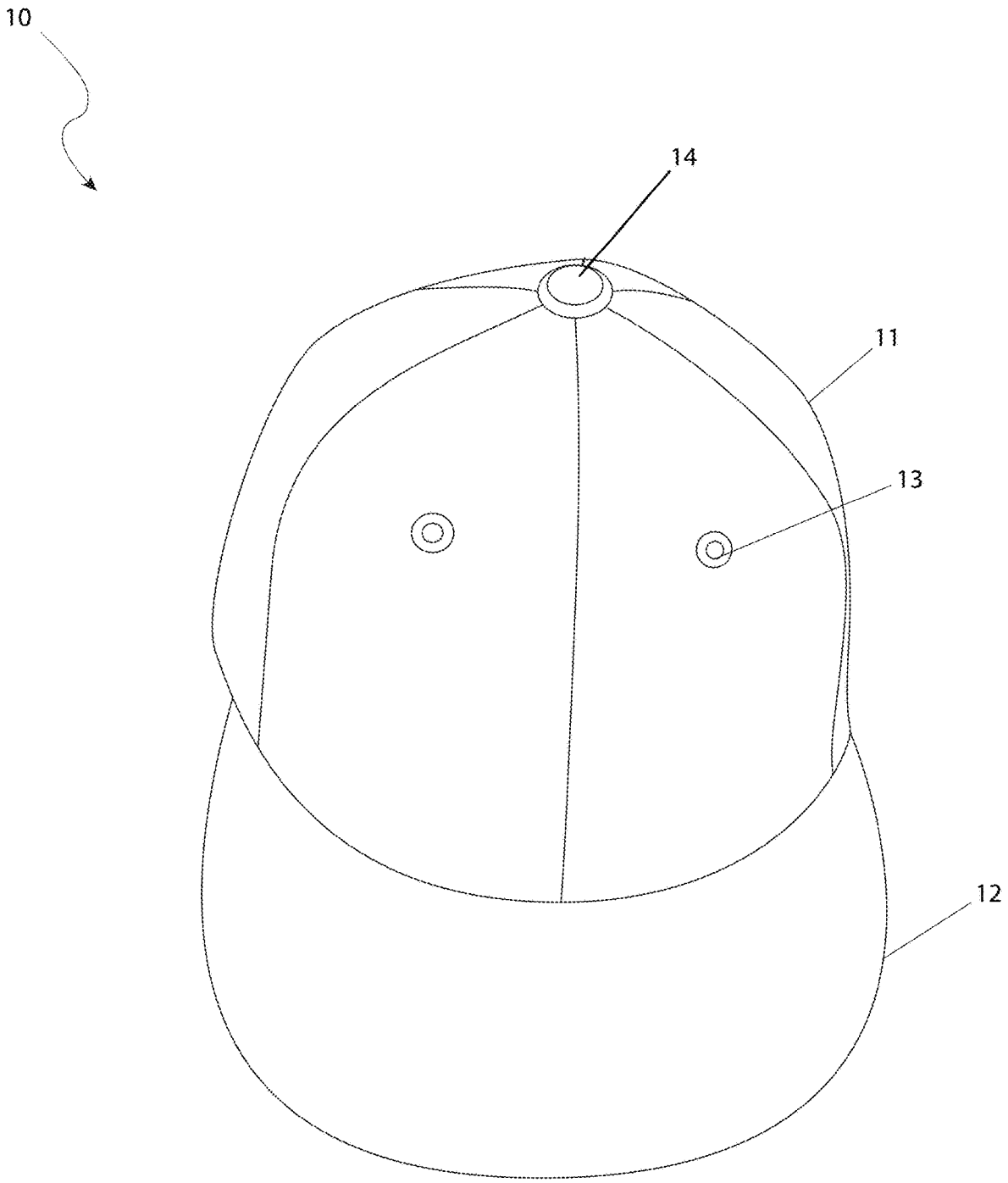
FIG. 1 is a top perspective view of headwear 10, according to the preferred embodiment of the present invention.

10 headwear
11 outer side
12 brim
13 vent hole
14 apex
15 interior
16 band
20 first impact absorbing feature
21 first fastening means
22 first body
30 second impact absorbing feature
31 second fastening means
32 second body
33 second body first side
34 second body second side
35 first side pleat
36 second side pleat
37 second body end
40 third impact absorbing feature
41 third fastening means
42 third body
45 seam

1. Description of the Invention

Figure 6:
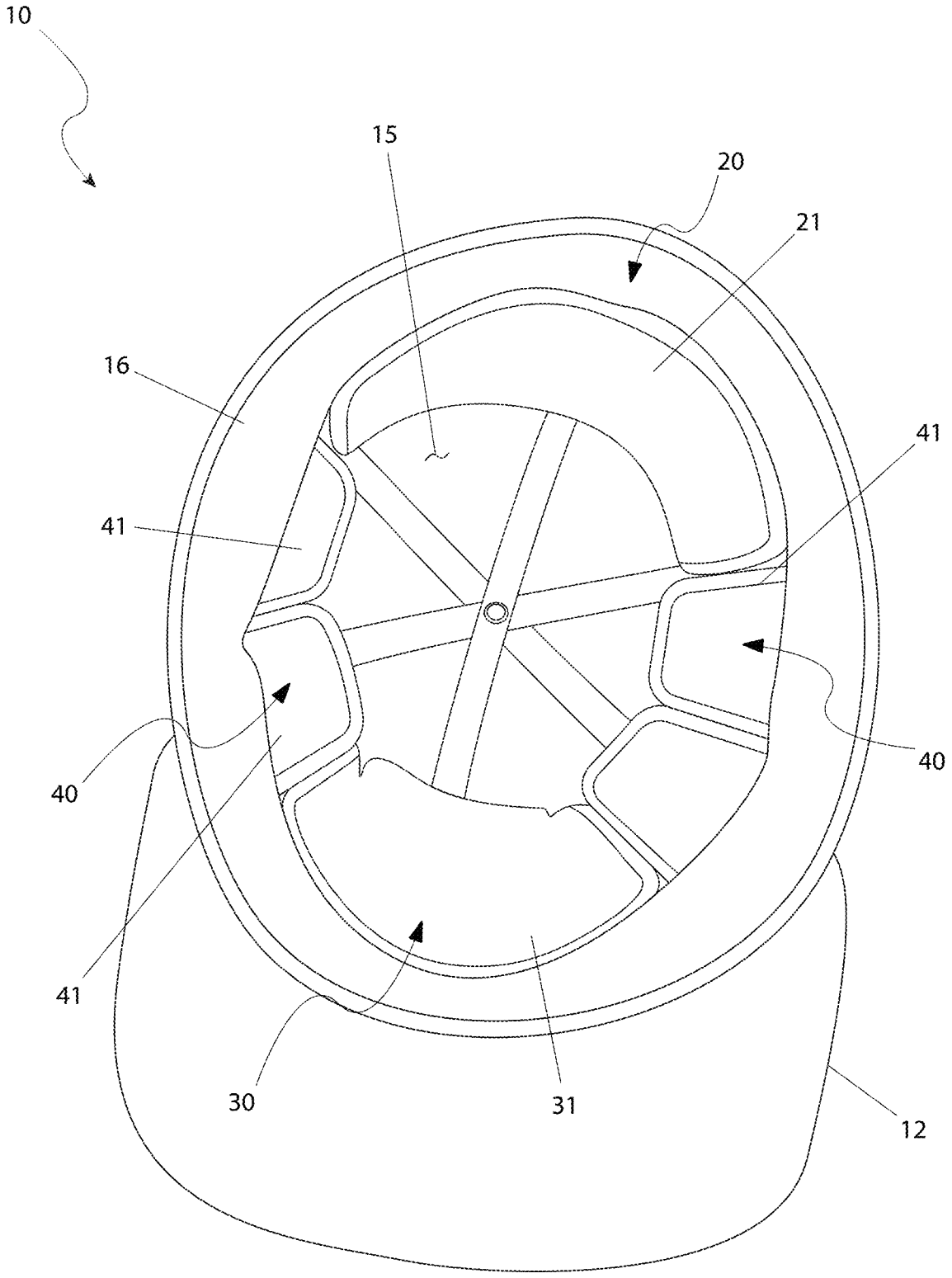

The best mode for carrying out the invention is presented in terms of its preferred embodiment, herein depicted within FIGS. 2 through 5*f* and in its preferred method of use, herein depicted within FIGS. 1 and 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Figure 2:
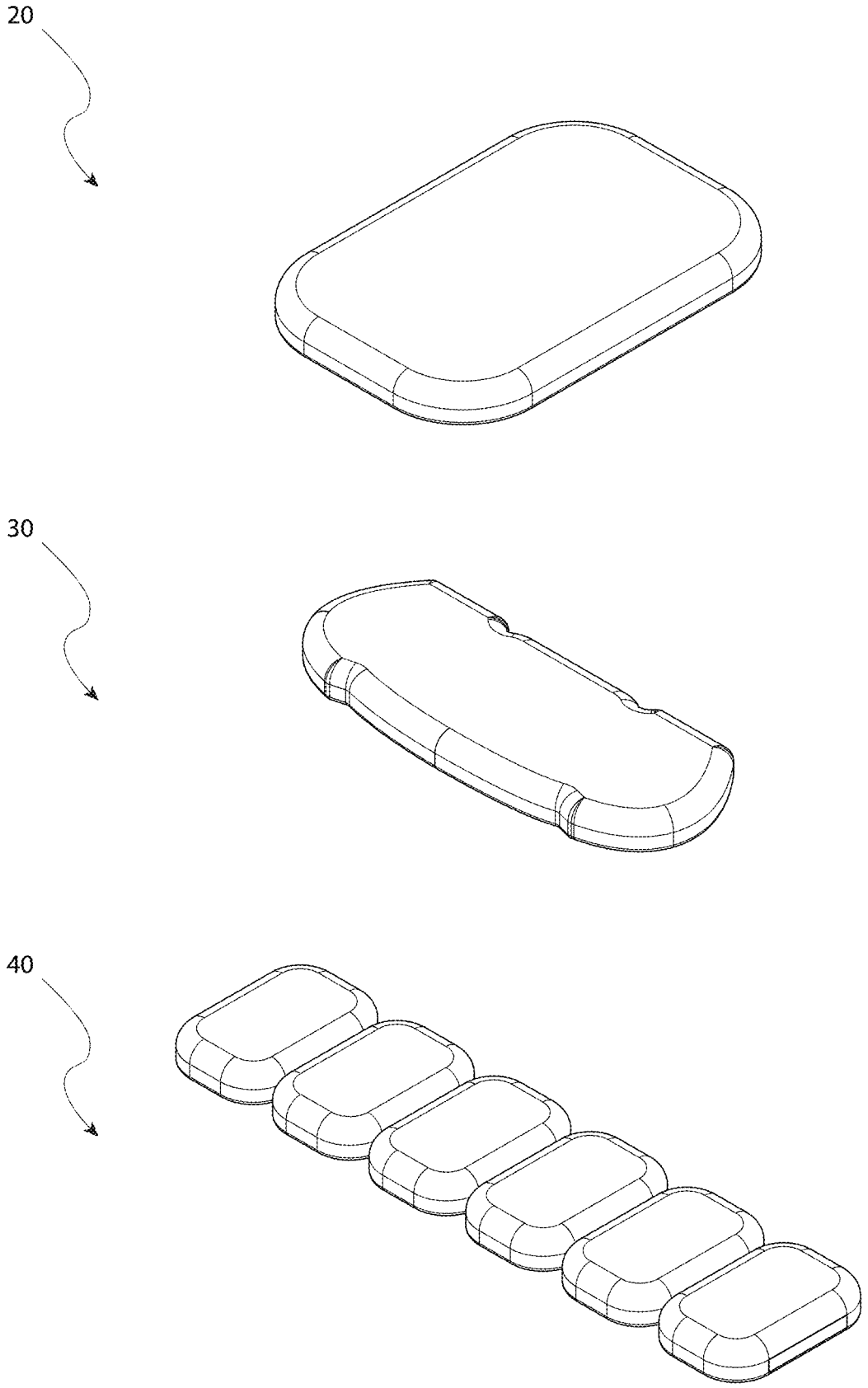
FIG. 2 is a perspective view of a first impact absorbing feature 20, a second impact absorbing feature 30, and a third impact absorbing feature 40, provided as a set for customizable use with headwear 10.
Figure 3A:
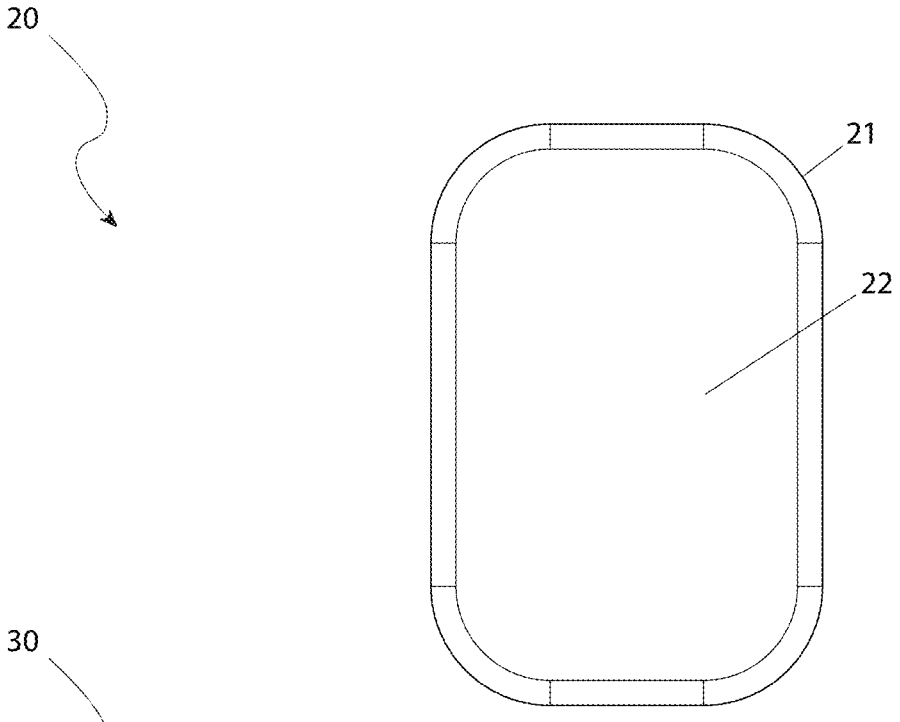
FIG. 3*a* is a top view of the first impact absorbing feature 20, according to the preferred embodiment of the present invention.
Figure 4A:
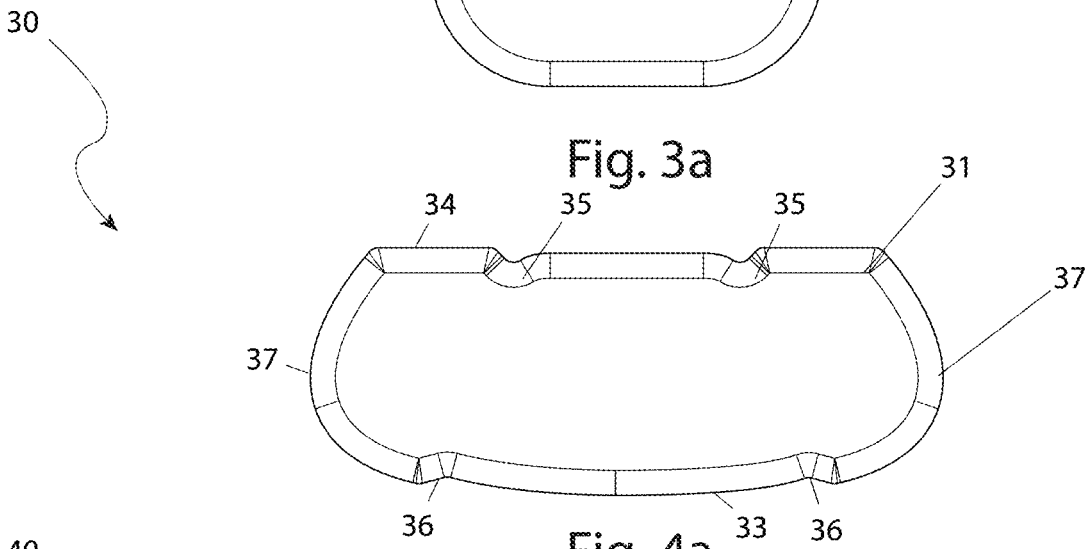
FIG. 4*a* is a top view of the second impact absorbing feature 30, according to the preferred embodiment of the present invention.
Figure 5A:
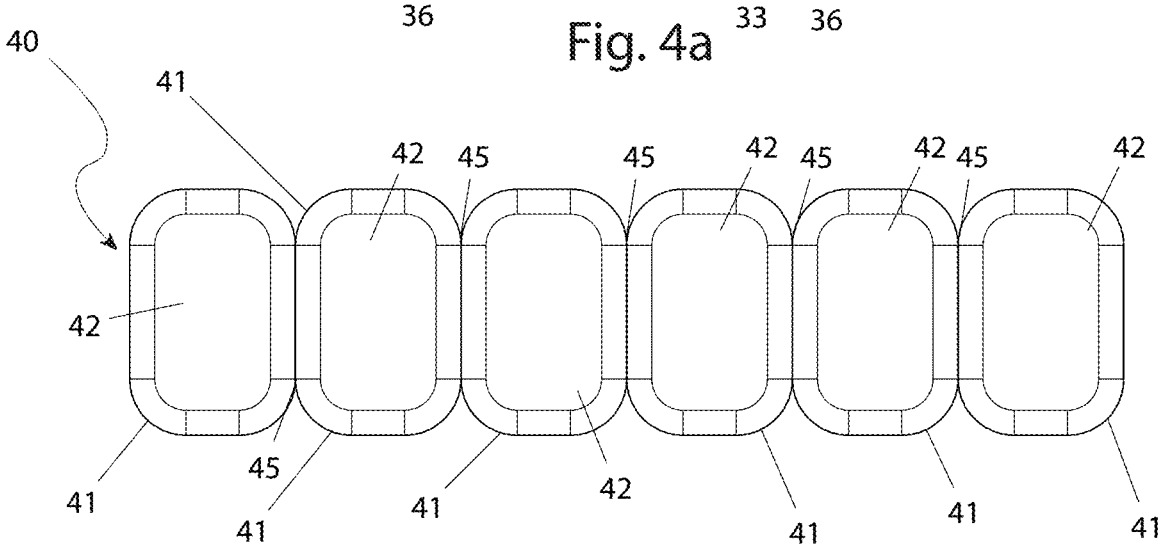
FIG. 5*a* is a perspective view of a third impact absorbing feature 40, according to the preferred embodiment of the present invention.
Figure 3B:
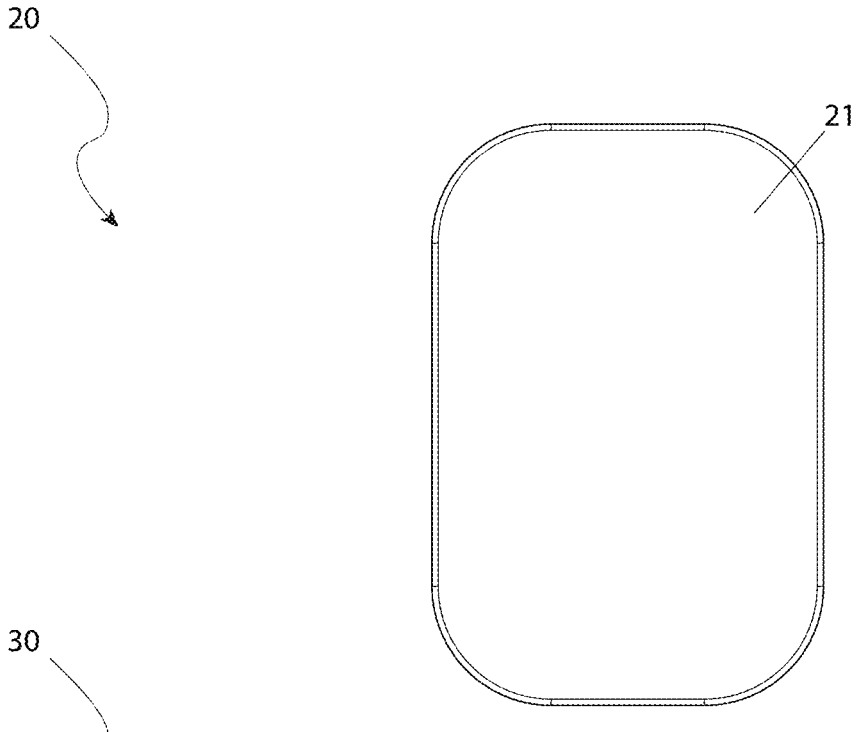
FIG. 3*b* is a bottom view of the first impact absorbing feature 20, according to the preferred embodiment of the present invention.
Figure 4B:
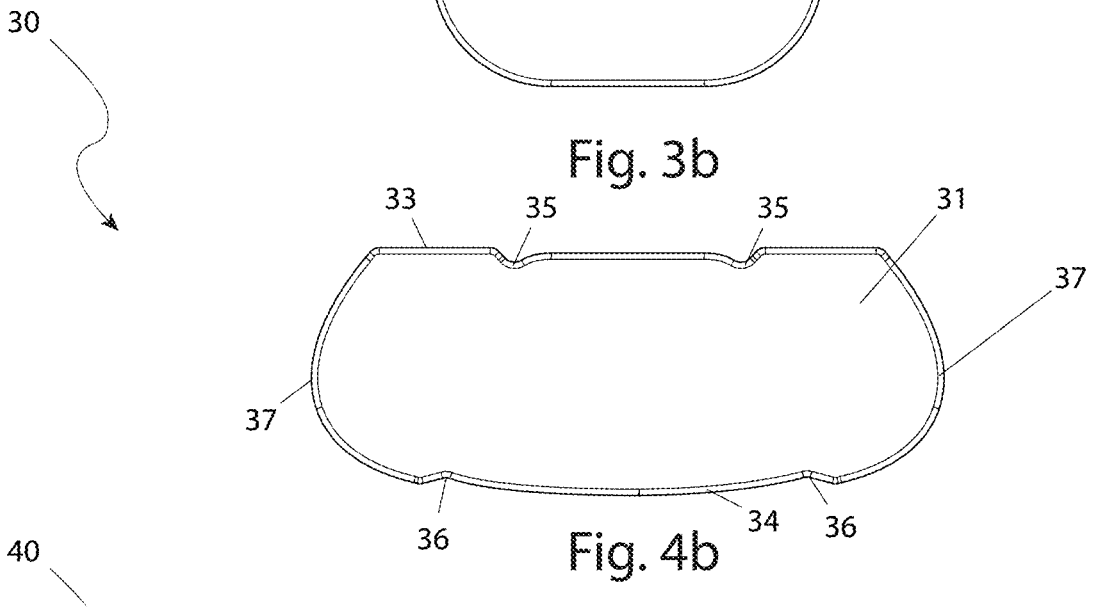
FIG. 4*b* is a bottom view of the second impact absorbing feature 30, according to the preferred embodiment of the present invention.
Figure 5B:
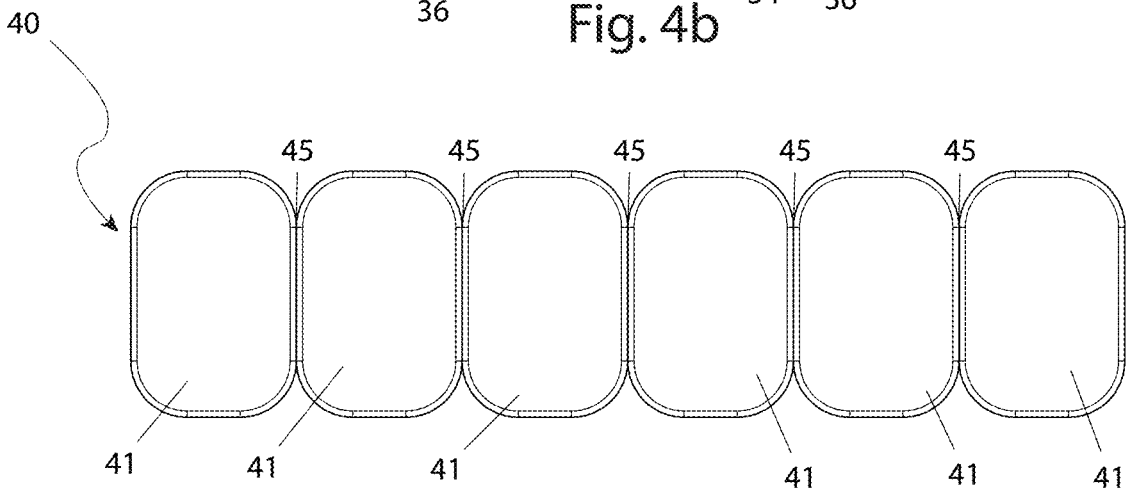
FIG. 5*b* is a bottom view of the third impact absorbing feature 30, according to the preferred embodiment of the present invention.
Figure 3C:
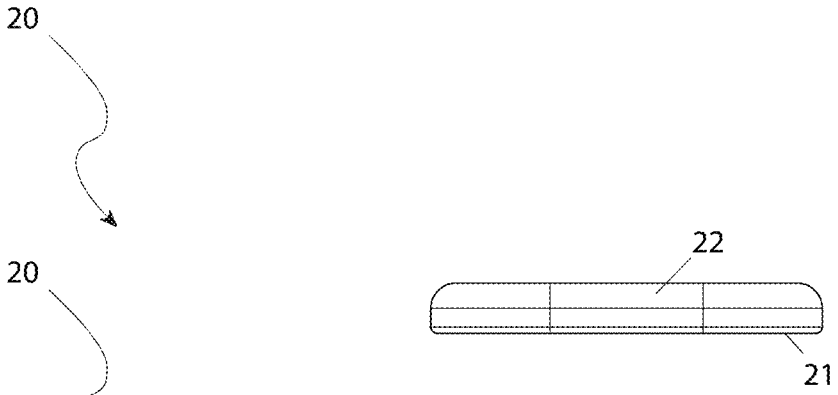
FIG. 3*c* is a first side view of the first impact absorbing feature 20, according to the preferred embodiment of the present invention.
Figure 3D:
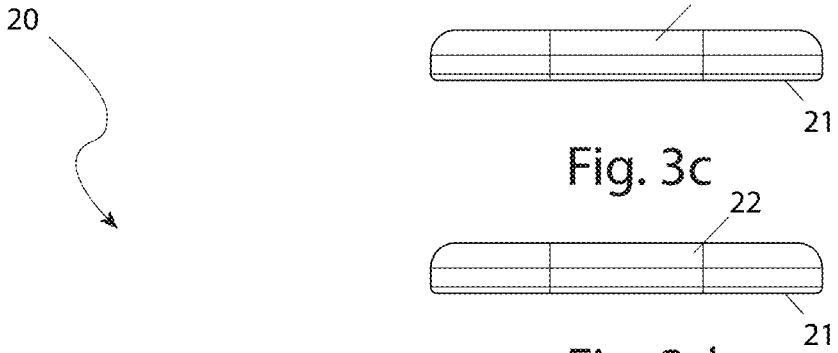
FIG. 3*d* is a second side view of the first impact absorbing feature 20, according to the preferred embodiment of the present invention.
Figure 4C:
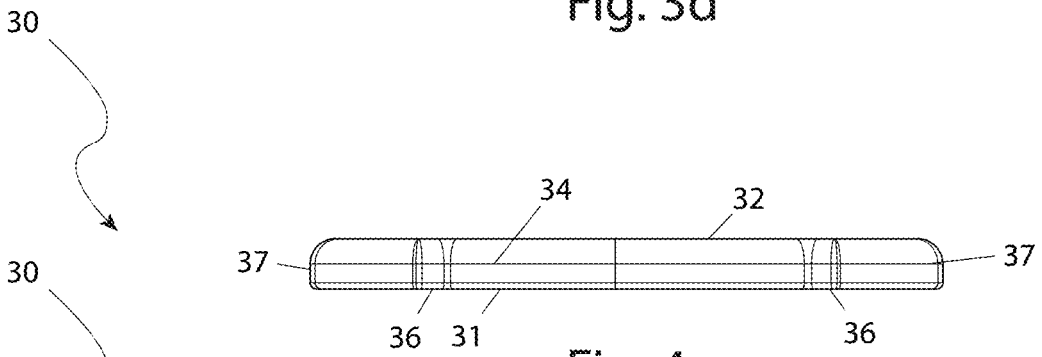
FIG. 4*c* is a first side view of the second impact absorbing feature 30, according to the preferred embodiment of the present invention.
Figure 4D:
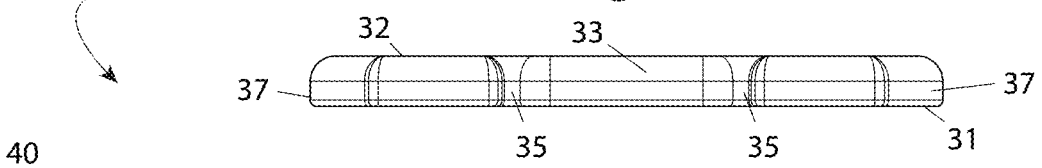
FIG. 4*d* is a second side view of the second impact absorbing feature 30, according to the preferred embodiment of the present invention.
Figure 5C:
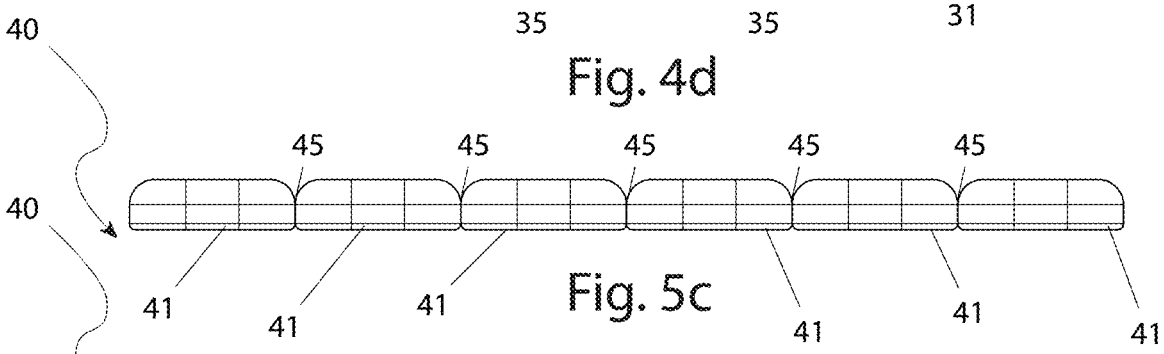
FIG. 5*c* is a first side view of the third impact absorbing feature 30, according to the preferred embodiment of the present invention.
Figure 5D:
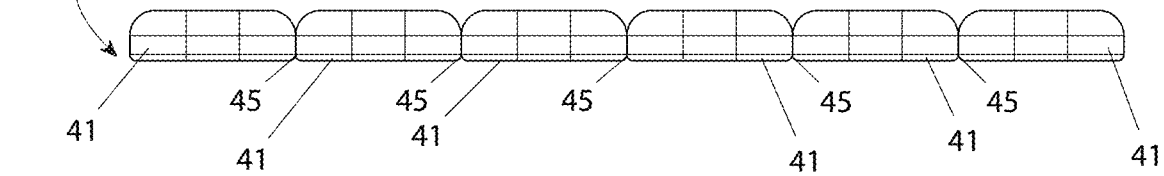
FIG. 5*d* is a second side view of the third impact absorbing feature 30, according to the preferred embodiment of the present invention.
Figure 3E:
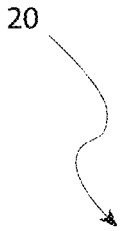
FIG. 3*e* is a first end view of the first impact absorbing feature 20, according to the preferred embodiment of the present invention.
Figure 3E:
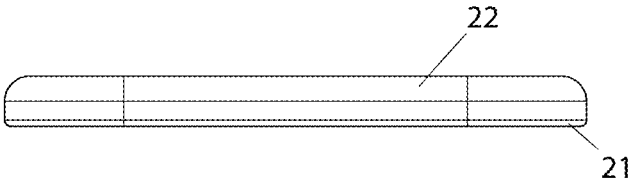
Figure 3F:
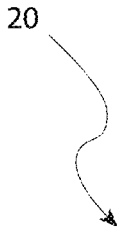
FIG. 3*f* is a second end view of the first impact absorbing feature 20, according to the preferred embodiment of the present invention.
Figure 3F:
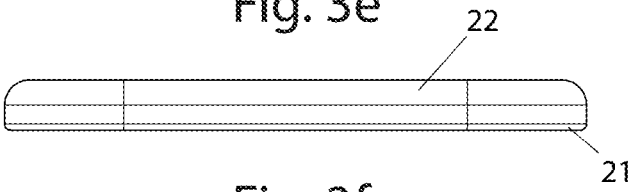
Figure 4E:
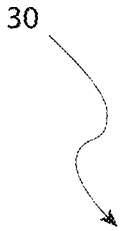
FIG. 4*e* is a first end view of the second impact absorbing feature 30, according to the preferred embodiment of the present invention.
Figure 4E:
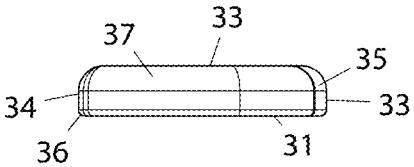
Figure 4F:
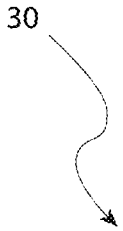
FIG. 4*f* is a second end view of the second impact absorbing feature 30, according to the preferred embodiment of the present invention.
Figure 4F:
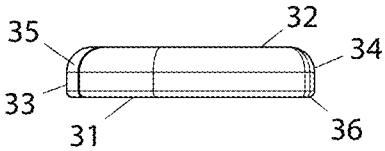
Figure 5E:
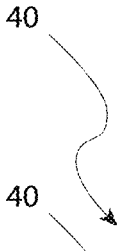
FIG. 5*e* is a first end view of the third impact absorbing feature 30, according to the preferred embodiment of the present invention.
Figure 5E:
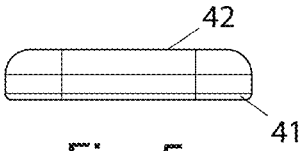
Figure 5F:
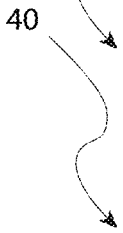
FIG. 5*f* is a second end view of the third impact absorbing feature 30, according to the preferred embodiment of the present invention; and, FIG. 6 is a bottom perspective view of the headwear 10, showing the first impact absorbing feature 20, the second impact absorbing feature 30, and a plurality of third impact absorbing features 40 installed within an interior 15 of the headwear 10, according to the preferred embodiment of the present invention.
Figure 5F:
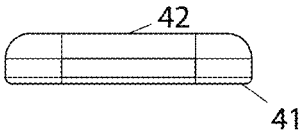

The invention includes headwear 10 that incorporates at least one (1) first impact absorbing feature 20, at least one (1) second impact absorbing feature 30, and at least one (1) third impact absorbing feature 40, each removably fastened to an interior 15 of the headwear 10. Referring to FIG. 1, it is seen that the headwear 10 from its outward appearance should look similar if not identical to a common and conventional baseball-style cap, including an outer surface 11, a brim 12, at least one (1) vent hole 13, and an apex 14. It is appreciated that other types of headwear 10 are envisioned to be utilized and shall fall under the overall scope of the present invention. Referring to FIG. 2, perspective views of at least one (1) first impact absorbing feature 20, at least one (1) second impact absorbing feature 30, and at least one (1) third impact absorbing feature 40 are provided in an exemplary embodiment.

Referring now to FIG. 3, each first impact absorbing feature 20 includes a first body 22 having a general rectangular shape with rounded corners and incorporates a first fastening means 21 located on a rear surface thereof. Each first absorbing feature 20 may comprise material similar to or identical with pipe foam material. The first body 22 is intended to have a generally padded surface that is intended to absorb impact from a blunt force, such as that would be experienced by a user wearing the headwear 10 with any of the first impact absorbing feature 20, second impact absorbing feature 30, and third impact absorbing feature 40 installed therein falls from a standing position onto a ground surface.

Referring now to FIG. 4, each second impact absorbing feature 30 includes a second body 32 having a second body first side 33, an opposing second body second side 34, and a pair of curvilinear second body ends 37. The second body ends 37 are shorter than the second body first side 33 and second body second side 34. The second body first side 33 has a central curvilinear portion that is discontinuous from the second body ends 37 and separated by a pair of first side pleats 35. The second body second side 34 is generally linear between the second body ends 37. A pair of second side pleats 36 are located on the second body second side 34 and offset from the first side pleats 35, relative to a bisecting axial centerline running perpendicular thereto. The first side pleats 35 and second side pleats 36 enable the shape of the second impact absorbing means 30 to be conformable. Each second absorbing feature 30 may comprise material similar to or identical with pipe foam material. A second fastening means 31 is located on a rear surface of the second body 32. Similar to the first body 22, the second body 32 is intended to have a generally padded surface that is intended to absorb impact from a blunt force, such as that would be experienced by a user wearing the headwear 10 with any of the first impact absorbing feature 20, second impact absorbing feature 30, and third impact absorbing feature 40 installed therein falls from a standing position onto a ground surface.

Referring now to FIG. 5, each third impact absorbing feature 40 includes a plurality of third bodies 42, each preferably identical and having a general rectangular shape and each incorporating a third fastening means 41 located on a rear surface thereof. The plurality of third bodies 42 are interconnected to each other at a seam 45 located along mating edges of individual third bodies 42, such that they are arranged in a linear arrangement. The seam 45 may be formed in an embodiment where the plurality of third bodies 42 are formed in a unitary feature, or it may be a conjoined section of an individual pair of mating sides of the third bodies 42. The seam 35 may also be perforated to enable separation of conjoined third bodies 42. The seam 45 may act as a living hinge to provide greater flexibility and customizable forming of the third impact absorbing feature 40. Each third absorbing feature 40 may comprise material similar to or identical with tactical foam material. The use of pipe foam and tactical foam provides thermal protection from the environment and also enhances flotation of the headwear 10 when attached thereto. Similar to the first body 22 and second body 32, the third body 42 is intended to have a generally padded surface that is intended to absorb impact from a blunt force, such as that would be experienced by a user wearing the headwear 10 with any of the first impact absorbing feature 20, second impact absorbing feature 30, and third impact absorbing feature 40 installed therein falls from a standing position onto a ground surface.

In an additional embodiment, the headwear 10 consists of the first impact absorbing feature 20, the second impact absorbing feature 30, and the third impact absorbing feature 40, which are integrally designed to function as a complete impact-absorbing system. The first impact absorbing feature 20 includes a first body 22 with rounded corners and is affixed to the rear interior 15 of the headwear 10 via a first fastening means 21, such as a hook-and-loop material. The second impact absorbing feature 30, consisting of a second body 32, includes pleated sides 35, 36 and is secured to both lateral sides of the interior 15 using a second fastening means 31. The third impact absorbing feature 40 includes a plurality of third bodies 42 connected via a flexible seam 45, forming a linear arrangement across the apex 14 and the front section of the headwear 10. The third fastening means 41 attaches the third bodies 42 to the interior 15, ensuring customizable impact protection. Each body-whether first, second, or third-incorporates high-density foam and moisture-wicking outer layers to maximize comfort and durability during high-impact activities. The seamless integration of these elements offers full circumferential protection while maintaining the headwear's lightweight design and breathability through vent holes 13.

In a preferred method of use, at least one (1) first impact absorbing feature 20 may be removably fastened to a rear of an interior 15 of the headwear 10 with the first fastening means 21, at least one (1) second impact absorbing feature 30 may be removably fastened to sides of the headwear 10 with the second fastening means 31, and at least one (1) third impact absorbing feature 40 may be removably fastened to sides of the headwear 10 with the third fastening means 41. At least a portion of each of the first impact absorbing features 20, second impact absorbing features 30, and third impact absorbing features 40 may be tucked behind the liner 16 of the headwear 10 to further enhance coupling to the headwear 10. Such first fastening means 21, second fastening means 31, and third fastening means 41 may be mating surfaces of hook-and-loop-type material. Other embodiments may utilize adhesive bonding intended to be waterproof and reusable.

The location and sizing and placement of each first impact absorbing feature 20, second impact absorbing feature 30, and third impact absorbing feature 40 may be customized for an individual's head based on age, gender, hairstyle, ethnicity, and common injury spots. Generally, each of first impact absorbing feature 20, second impact absorbing feature 30, and third impact absorbing feature 40 may be approximately one-half inch (½ in.) thick and approximately three inches (3 in.) in height. Each of the first impact absorbing feature 20, second impact absorbing feature 30, and third impact absorbing feature 40 are washable. Each first impact absorbing feature 20, second impact absorbing feature 30, and third impact absorbing feature 40 incorporate a sweat-absorbing material layer to aid in the reduction of odor.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A protective headwear device comprising:

a headwear structure having an outer surface, an interior surface, a brim, an apex, and at least one vent hole;

a first impact absorbing feature disposed within a rear section of the interior surface of the headwear, said first impact absorbing feature comprising:

a first body having a generally rectangular shape with rounded corners; and, a first fastening means affixed to a rear surface of the first body for removably attaching the first body to the interior surface of the headwear; and, a second impact absorbing feature disposed on opposing lateral sides of the interior surface of the headwear, said second impact absorbing feature comprising:

a second body having a first side, an opposing second side, and a pair of curvilinear ends;

a pair of first side pleats formed on the first side of the second body and a pair of second side pleats formed on the second side of the second body, enabling the second body to conform to the shape of the interior surface of the headwear; and, a second fastening means affixed to a rear surface of the second body for removably attaching the second body to the interior surface of the headwear; and, a third impact absorbing feature disposed at the apex and extending to the front section of the interior surface of the headwear, said third impact absorbing feature comprising:

a plurality of third bodies, each having a generally rectangular shape, interconnected along adjacent sides by a seam; and, a third fastening means affixed to a rear surface of each third body for removably attaching the third bodies to the interior surface of the headwear; and, wherein said first body is composed of a high-density foam material configured to absorb impact forces applied to the rear section of the headwear;

wherein the second body is composed of a high-density foam material configured to absorb impact forces applied to the lateral sides of the headwear; and, wherein the plurality of third bodies are composed of a high-density foam material configured to absorb impact forces applied to the apex and front section of the headwear.

2. The protective headwear device of claim 1, wherein the first fastening means comprises a hook-and-loop fastening system, enabling removable attachment of the first body to the interior surface of the headwear.

3. The protective headwear device of claim 1, wherein the second fastening means comprises a hook-and-loop fastening system, enabling removable attachment of the second body to the interior surface of the headwear.

4. The protective headwear device of claim 1, wherein the first side pleats and second side pleats of the second body are offset relative to each other along a bisecting axial centerline, enhancing the conformability of the second body to the shape of the headwear.

5. The protective headwear device of claim 1, wherein the seam between the plurality of third bodies is perforated, enabling selective separation of individual third bodies to customize the coverage area.

6. The protective headwear device of claim 1, wherein the third fastening means comprises a hook-and-loop fastening system, enabling removable attachment of each third body to the interior surface of the headwear.

7. The protective headwear device of claim 1, wherein the seam between the plurality of third bodies functions as a living hinge, providing flexibility for the third impact absorbing feature to conform to the shape of the apex and front section of the headwear.

8. The protective headwear device of claim 1, wherein at least one of the first impact absorbing feature, the second impact absorbing feature, and the third impact absorbing feature includes a moisture-wicking outer layer to enhance comfort during extended wear and reduce heat buildup.

9. The protective headwear device of claim 1, wherein the first impact absorbing feature, the second impact absorbing feature, and the third impact absorbing feature each have a thickness of approximately one-half inch and a height of approximately three inches, and are configured to be washable for ease of maintenance.

10. The protective headwear device of claim 1, wherein the high-density foam material used in the first impact absorbing feature, the second impact absorbing feature, and the third impact absorbing feature provides both thermal protection and flotation capability for the headwear.

11. The protective headwear device of claim 1, wherein the location and sizing of the first impact absorbing feature, the second impact absorbing feature, and the third impact absorbing feature are customizable to fit a user's head based on at least one of age, gender, hairstyle, or common injury spots.

12. The protective headwear device of claim 1, wherein the first fastening means, second fastening means, and third fastening means comprise a waterproof adhesive for permanent attachment to the interior surface of the headwear.

* * * * *